US008801211B2

(12) United States Patent
Lee

(10) Patent No.: US 8,801,211 B2
(45) Date of Patent: Aug. 12, 2014

(54) LAMP CASING STRUCTURE

(75) Inventor: Wei-Long Lee, Taipei (TW)

(73) Assignee: Taiwan Oasis Technology Co., Ltd., Taipei (TW)

( * ) Notice: Subject to any disclaimer, the term of this patent is extended or adjusted under 35 U.S.C. 154(b) by 424 days.

(21) Appl. No.: 13/223,376

(22) Filed: Sep. 1, 2011

(65) Prior Publication Data

US 2013/0058105 A1 Mar. 7, 2013

(51) Int. Cl.

| | |
|---|---|
| ***G09F 13/04*** | (2006.01) |
| ***F21S 8/04*** | (2006.01) |
| ***F21S 8/00*** | (2006.01) |
| ***F21V 15/01*** | (2006.01) |
| *F21V 3/00* | (2006.01) |

(52) U.S. Cl.

CPC .. *F21S 8/033* (2013.01); *F21S 8/04* (2013.01); *F21V 3/00* (2013.01); *F21V 15/01* (2013.01)

USPC ..... 362/97.4; 362/97.1; 362/374; 362/375

(58) Field of Classification Search

CPC .. G02B 6/0011; G02B 6/0033; G02B 6/0035; G02B 6/0081; G02B 6/0086; G02B 6/0088; G02B 6/0093; G02F 1/1335; G02F 1/133602; G02F 1/133608; G02F 1/133504; G02F 1/133524; G02F 1/133615; G02F 1/1336; F21V 21/00; F21V 2008/006; F21V 17/00; F21V 17/10; F21V 17/104; F21V 17/108; F21V 17/14; F21V 17/16; F21V 17/162; F21V 17/164

USPC ..... 362/374, 375, 433, 455, 97.1, 97.2, 362/97.4, 632, 633, 634; 349/58, 60, 63

See application file for complete search history.

(56) References Cited

U.S. PATENT DOCUMENTS

| | | | | |
|---|---|---|---|---|
| 6,154,261 | A * | 11/2000 | Shim | 349/58 |
| 7,905,619 | B2 * | 3/2011 | Iwamoto | 362/97.4 |
| 2002/0114152 | A1 * | 8/2002 | Fujino et al. | 362/31 |
| 2007/0070650 | A1 * | 3/2007 | Chen et al. | 362/633 |

* cited by examiner

*Primary Examiner* — Thomas Sember

(74) *Attorney, Agent, or Firm* — Jackson IPG PLLC

(57) ABSTRACT

The present invention discloses a lamp casing structure that can be assembled and installed easily and applicable for different installation methods. The lamp casing structure comprises a plurality of frame strips coupled to one another and disposed around a first transparent cover, a plurality of fasteners disposed at each frame strip and inserted into latch portions of the frame strip and the first transparent cover respectively, so that the lamp casing structure can be assembled and installed simply by a latching step, and the lamp casing structure can be installed on a wall or a ceiling, or embedded into grids of a light steel frame.

20 Claims, 16 Drawing Sheets

LAMP CASING STRUCTURE

FIELD OF THE INVENTION

The present invention relates to a lamp casing, in particular to the lamp casing structure applicable for different installation methods.

BACKGROUND OF THE INVENTION

The most popular electronic device used in our life is nothing more than illumination lamps. With the use of the illumination lamps, our working time can be extended to overcome the limitations of sunlight on our working time, and thus families and stores require the illumination lamps, and offices, department stores, exhibition sites, and supermarkets generally use a large quantity of illumination lamps.

Regardless of commercial places or homes, different numbers of lamps are installed according to the space planning, and the emitting light and the direction of light are used skillfully to achieve the spatial and route planning effects. As technologies advance, increasingly more choices of the lamps are provided.

In various different lamps available in the market, these lamps vary with their function, installation location and appearance, so that the stylish design of the lamp casing will change and cannot be used for different models of lamps. As a result, it is necessary to purchase a specific type of lamp casing to meet the spatial planning requirement if the installation position or the installation object is changed.

Most of the lamp casings removed due to a change of the installation position or an installation object cannot be used for other purposes, and they are left unused or even discarded, thus causing an unnecessary waste of equipment costs and resources. Therefore, it is a subject for related manufacturers to design a lamp casing that fits different installation methods.

SUMMARY OF THE INVENTION

In view of the problems of the prior art, it is a primary objective of the present invention to provide a lamp casing structure that can be assembled and installed easily and is applicable for various different installation methods.

To achieve the aforementioned objective, the present invention provides a lamp casing structure comprising: a first transparent cover, a predetermined quantity of frame strips, and a predetermined quantity of fasteners, wherein the frame strips are coupled with one another and disposed around the periphery of the first transparent cover, and each frame strip includes an insert slot formed on an internal side of the frame strip for embedding the light board, and each frame strip includes a latch portion disposed at a middle section of the frame strip; the first transparent cover includes a latch portion disposed around the first transparent cover and at a position corresponding to the middle section of each frame strip; and each fastener includes a latch portion disposed at each frame strip, a first latch for latching the latch portion of the frame strip, and a second latch for latching the latch portion of the first transparent cover, so as to constitute the lamp casing structure that can be assembled and installed easily by a simple latching step and can be installed onto a wall or a ceiling or embedded into grids of a light steel frame.

Besides the basic components, the lamp casing structure of the present invention further comprises a second transparent cover, wherein the second transparent cover has a contour shape matched with the first transparent cover for sheathing the second transparent cover on the other side of the first transparent cover, and the second transparent cover also includes a latch portion disposed around the second transparent cover and at a position corresponding to the middle section of each frame strip, and each fastener is installed at the latch portion of each frame strip, and each fastener includes a first latch for latching the latch portion of the frame strip, and two second latches for latching the latch portion of the first transparent cover and the latch portion of the second transparent cover respectively. Therefore the whole lamp casing has the light illumination effects on both sides.

Besides the basic components, the lamp casing structure of the present invention further comprises a dust cover which is a plate installed on another side of the first transparent cover. The dust cover includes an embedding groove formed on an internal side of the frame strip and around the periphery of the frame strip; and each fastener has a first latch for latching the latch portion of the frame strip and a second latch for latching the latch portion of the first transparent cover. The dust cover provides a shielding effect and a more aesthetic appearance of the lamp casing.

More specifically, the lamp casing structure of the present invention has the following effects:

1. The assembling and installation can be completed with a simple latching step, and thus the invention not only provides an easy assembling an installation, but also lowers the assembling and installation costs.

2. The lamp shell structure can be installed on a wall or a ceiling, or embedded into grids of a light steel frame, or even hanged by a steel cable, and thus the invention provides better applicability and practicality.

DESCRIPTION OF THE PREFERRED EMBODIMENTS

The technical characteristics and effects of the present invention will become apparent by the detailed description of preferred embodiments and related drawings as follows.

Preferred Embodiment 1

Figure 1:
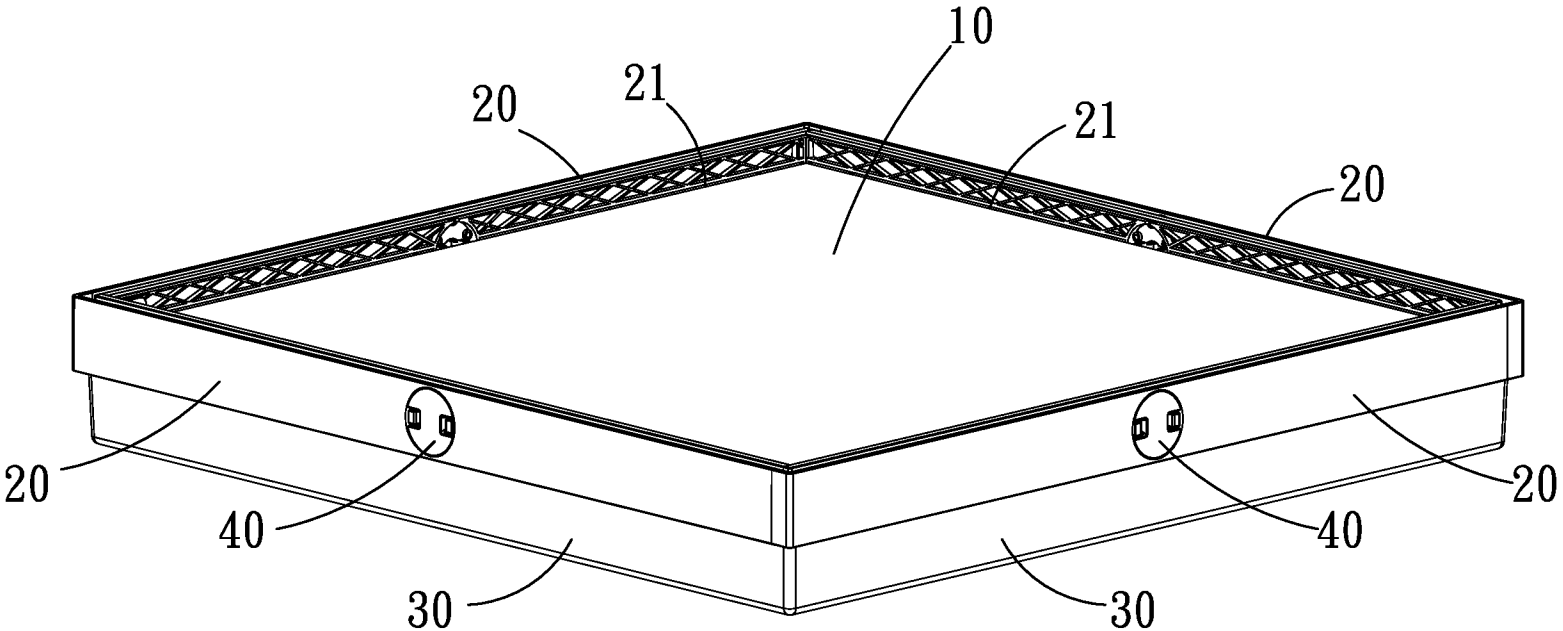
FIG. 1 is a perspective view of a lamp casing structure in accordance with a first preferred embodiment of the present invention.
Figure 2:
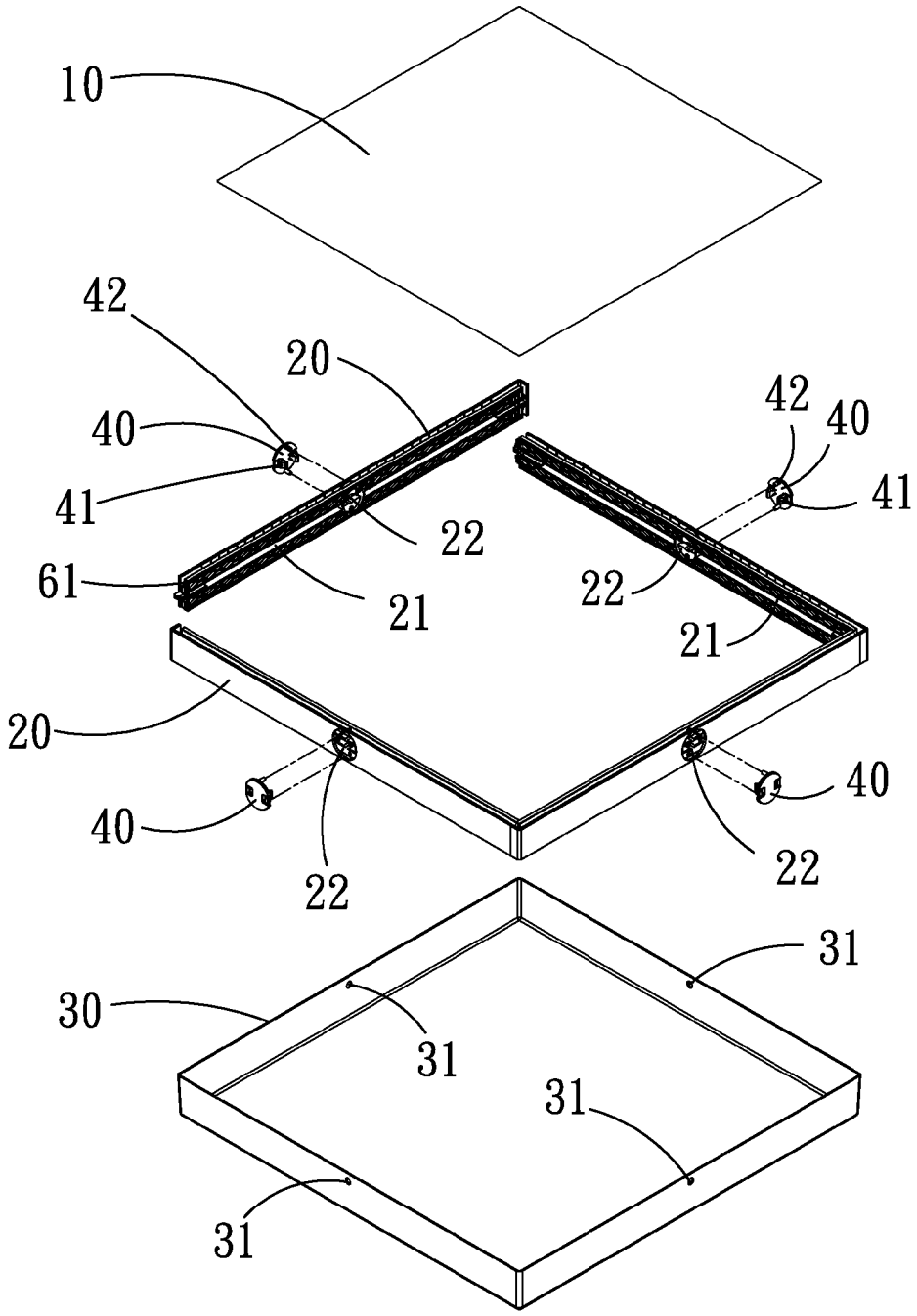
FIG. 2 is an exploded view of a lamp casing structure in accordance with the first preferred embodiment of the present invention.

With reference to FIGS. 1 and 2 for a perspective view and an exploded view of a lamp casing structure in accordance with a first preferred embodiment of the present invention respectively, the present invention provides a shielding effect for a light board 10 of a lamp, and further uses an assembly with a frame strip 20, a first transparent cover 30 and a fastener 40 to provide an easy assembling and installation and different ways of installing the lamp casing structure. The lamp casing structure of the present invention comprises: a predetermined quantity of frame strips 20, at least one first transparent cover 30, and a predetermined quantity of fasteners 40.

The frame strips 20 are coupled to one another and disposed around the periphery of the first transparent cover, and each frame strip 20 includes an insert slot 21 formed on an internal side of the frame strip 20 for embedding the light board 10, and a latch portion 22 formed at a middle section of the frame strip 20.

The first transparent cover 30 constitutes the main light emitting surface of the lamp casing structure, and the first transparent cover 30 includes a latch portion 31 formed at a position corresponding to the middle section of each frame strip 20.

Each fastener 40 is installed at the latch portion 22 of each frame strip 20, and each fastener 40 includes a first latch 41 for latching the latch portion 22 of the frame strip 20 and a second latch 42 for latching the latch portion 31 of the first transparent cover 30.

Basically, the light board 10 of the present invention serves as a driving circuit for installing and electrically coupling optoelectronic components. In a preferred embodiment, the light board 10 can be a printed circuit board with a driving circuit and having a predetermined quantity of optoelectronic components, and at least two insert slots 21 for embedding the frame strip 20 to achieve the effects of assembling, installing and fixing the lamp casing.

Figure 10:
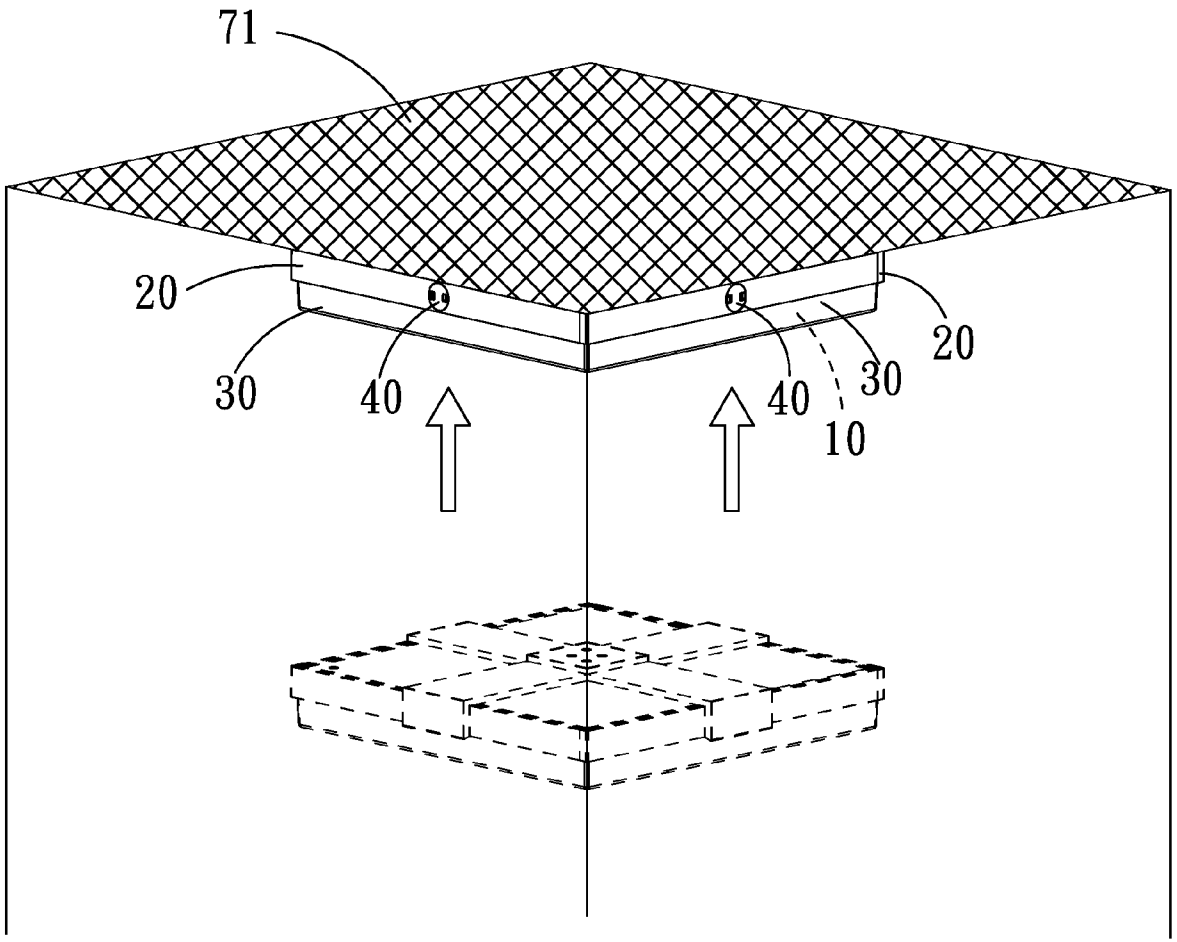
FIG. 10 is a schematic view of an application of a lamp casing structure installed at a ceiling in accordance with the present invention.
Figure 11:
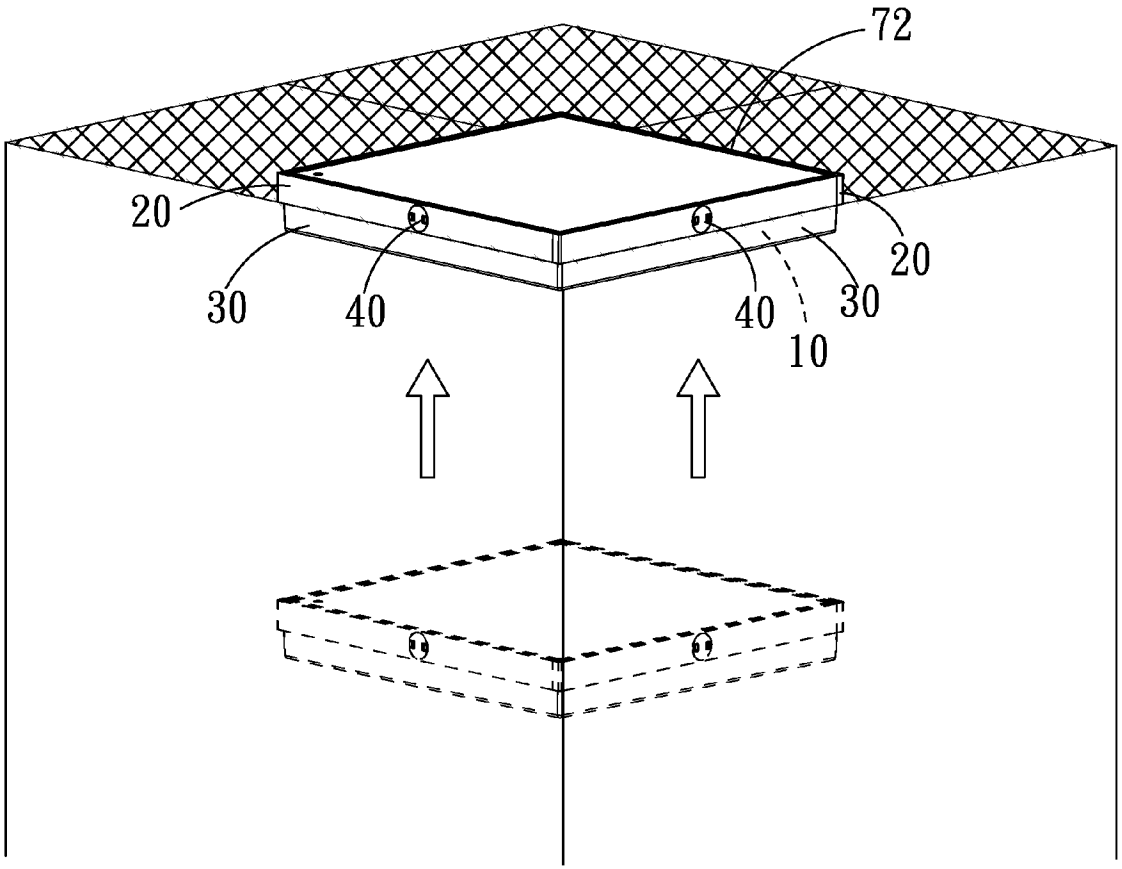
FIG. 11 is a schematic view of an application of a lamp casing structure embedded into grids of a light steel frame in accordance with the present invention.

With the aforementioned technical characteristics, the lamp casing structure of the present invention comprises the plurality of frame strips 20 installed around the first transparent cover 30, and the plurality of fasteners 40 installed at the latch portions 22, 31 of the each frame strip 20 for inserting the frame strip 20 and the first transparent cover 30 to complete the installation by as simple latching step. In FIG. 10, the lamp casing structure is installed at a ceiling 71 (or a wall). In FIG. 11, the lamp casing structure is embedded into grids of a light steel frame 72.

In addition to the aforementioned preferred embodiment, the following two preferred embodiments are provided for illustrating the present invention.

Preferred Embodiment 2

Figure 3:
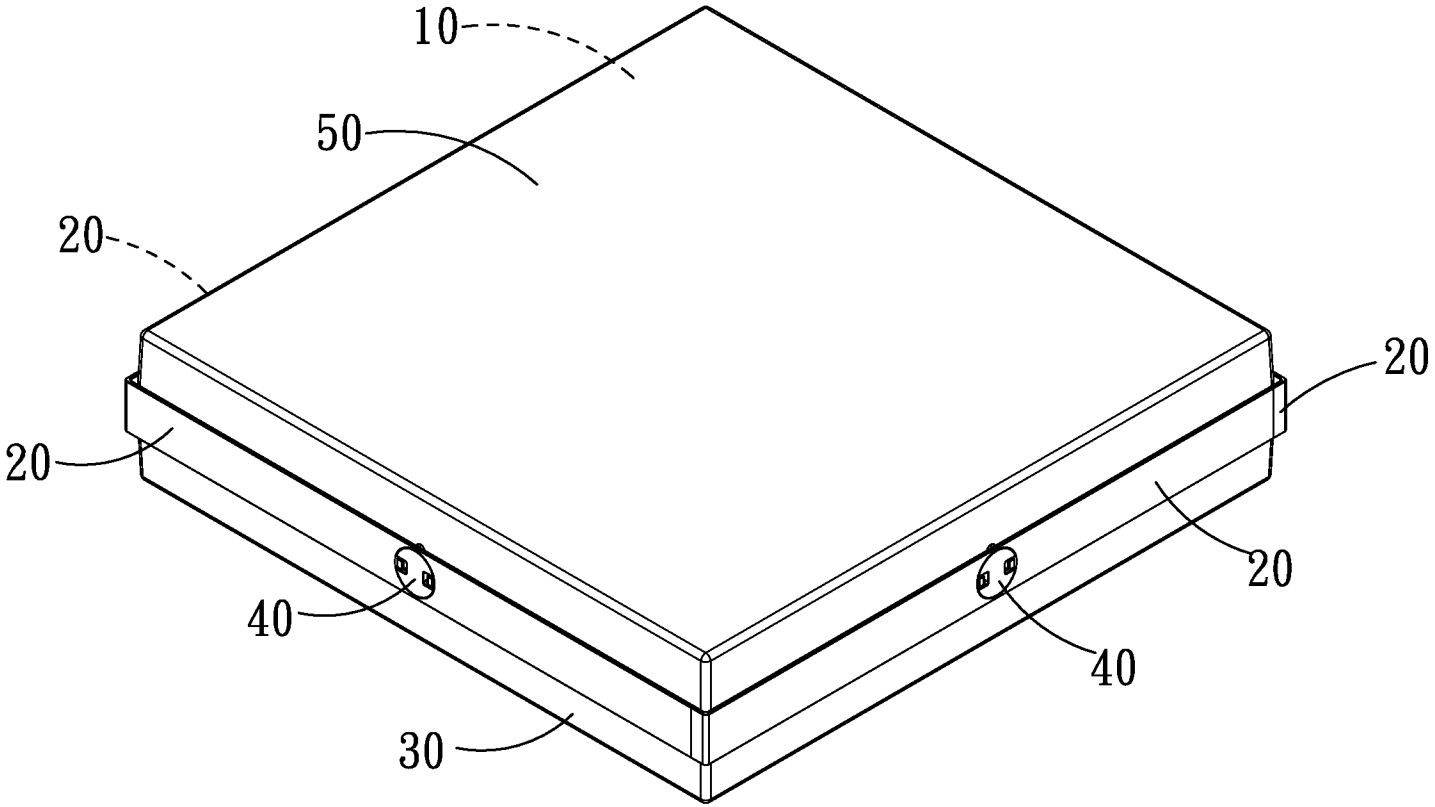
FIG. 3 is a perspective view of a lamp casing structure in accordance with a second preferred embodiment of the present invention.
Figure 4:
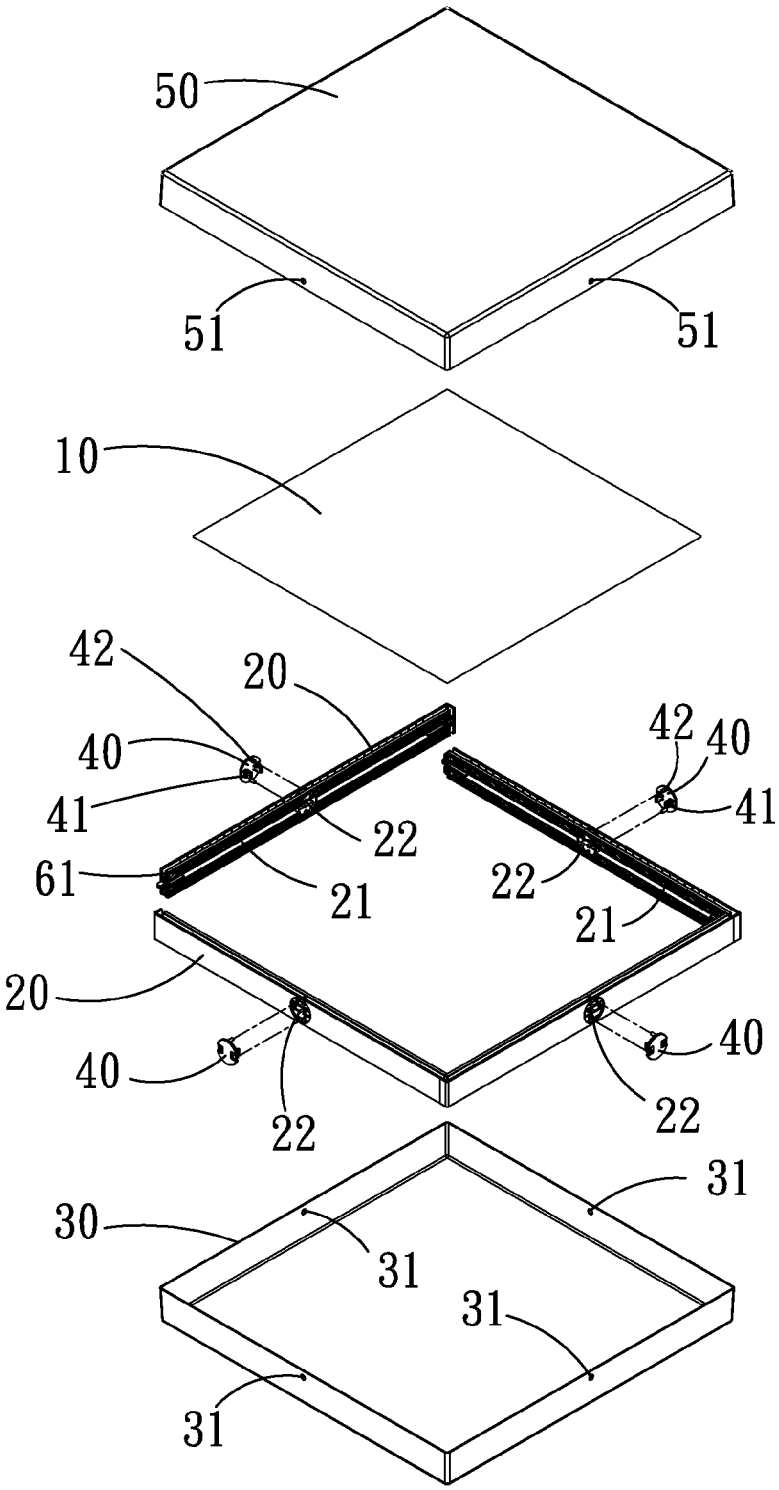
FIG. 4 is an exploded view of a lamp casing structure in accordance with the second preferred embodiment of the present invention.

With reference to FIGS. 3 and 4 for a lamp casing structure in accordance with the second preferred embodiment of the present invention, the lamp casing structure comprises a predetermined quantity of frame strips 20, a first transparent cover 30, a second transparent cover 50, and a predetermined quantity of fasteners 40.

The frame strip 20 are coupled with one another and disposed around the periphery of the first transparent cover, and each frame strip 20 includes an insert slot 21 formed on an internal side of the frame strip 20 for embedding the light board 10, and each frame strip 20 includes a latch portion 22 disposed at the middle section of the frame strip 20.

The first transparent cover 30 is the main light emitting surface of the lamp casing structure, and the first transparent cover 30 includes a latch portion 31 disposed at the periphery of the first transparent cover 30 and corresponding to the middle section of the frame strip 20.

The second transparent cover 50 has a contour shape matched with the first transparent cover 30 for sheathing on another side of the first transparent cover 30, and the second transparent cover 50 also includes a latch portion 51 disposed at the periphery of the second transparent cover 50 and corresponding to the middle section of the frame strip 20.

Each fastener 40 is installed at the latch portion 22 of each frame strip 20, and each fastener 40 includes a first latch 41 for latching the latch portion 22 of the frame strip 20, and two second latches 42 for latching the latch portion 31 of the first transparent cover 30 and the latch portion 51 of the second transparent cover 50 respectively.

In the lamp casing structure of this preferred embodiment, a first transparent cover 30 and a second transparent cover 50 are installed at two surfaces of the light board 10, and both surfaces of the light board 10 are provided for installing a predetermined quantity of optoelectronic components, so that the lamp can provide an illumination effect on both sides.

Preferred Embodiment 3

Figure 5:
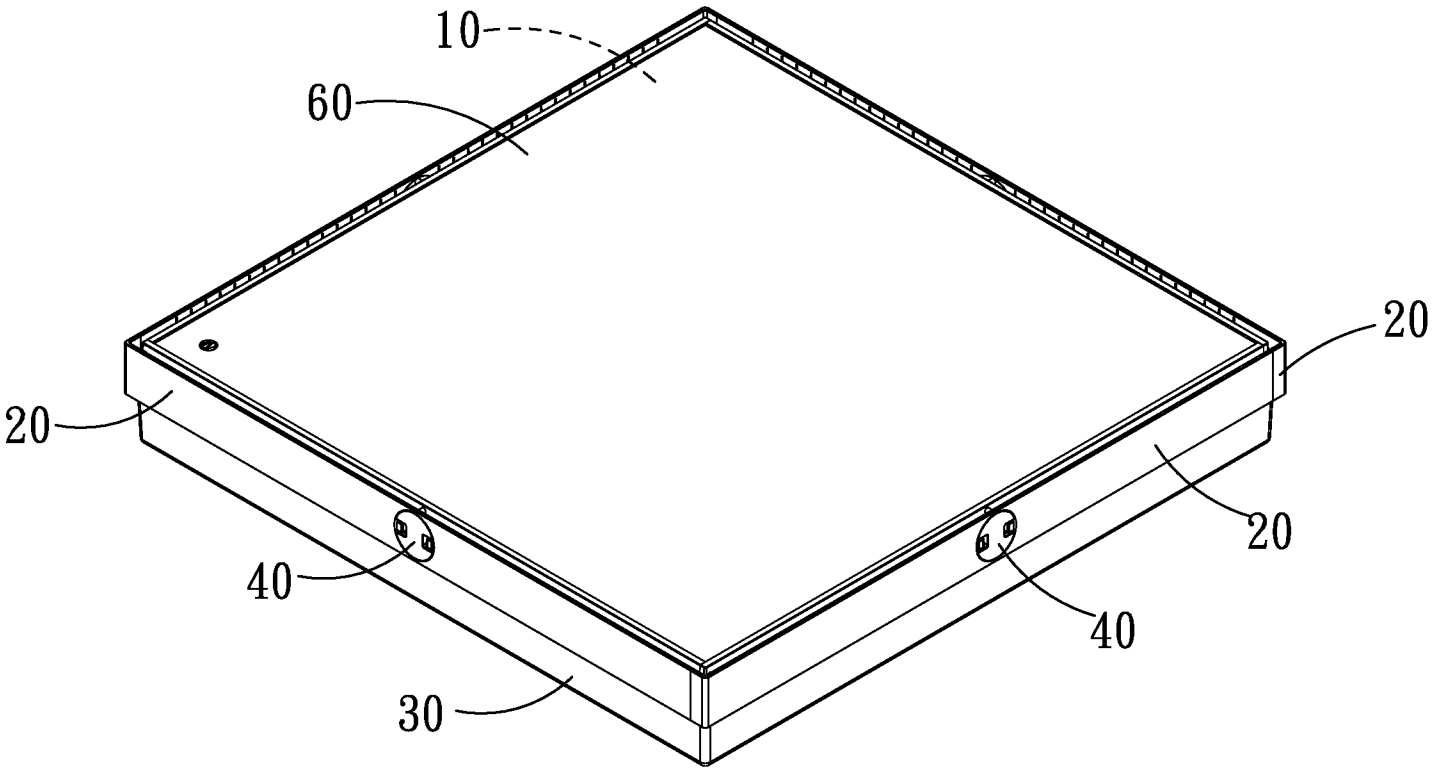
FIG. 5 is a perspective view of a lamp casing structure in accordance with a third preferred embodiment of the present invention.
Figure 6:
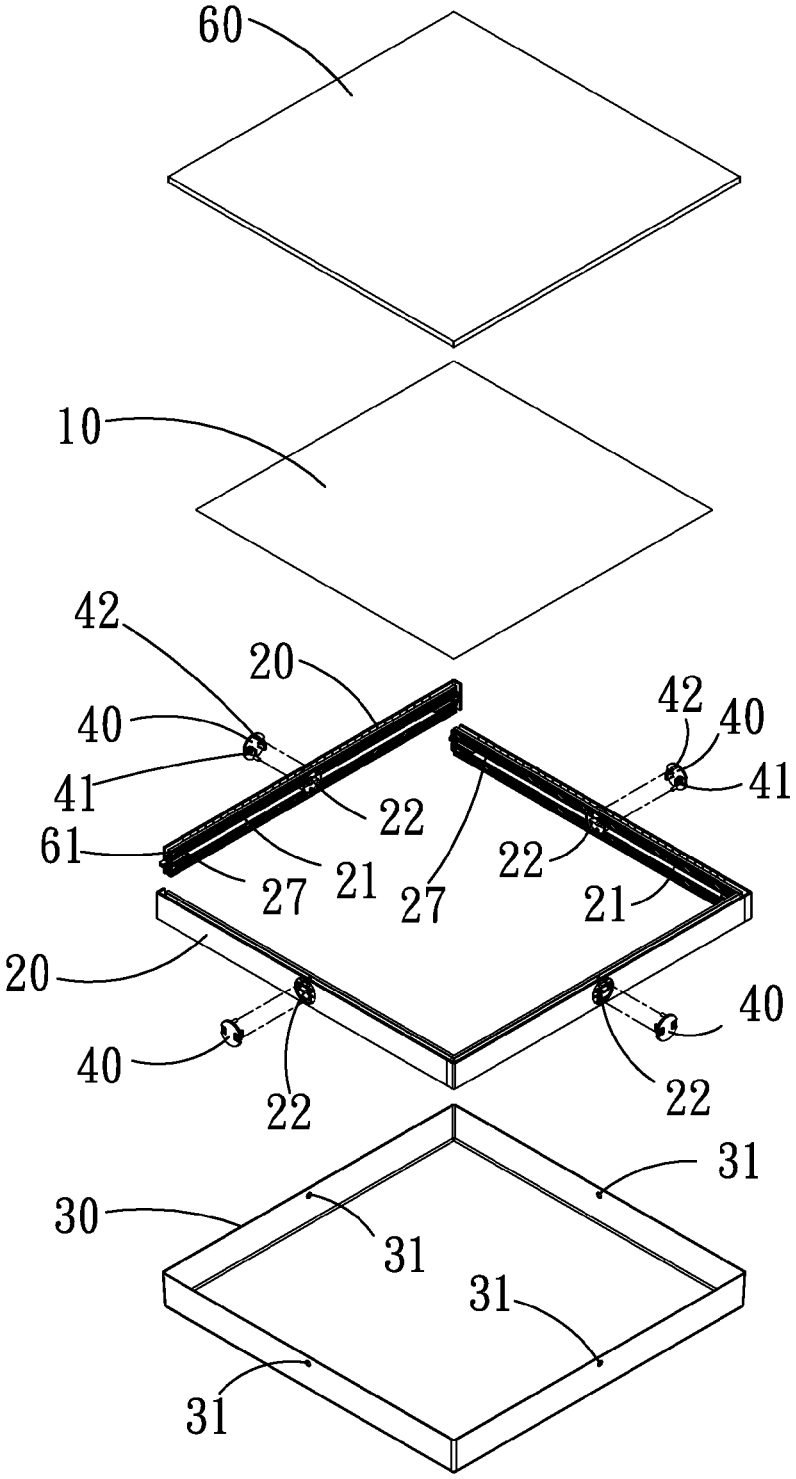
FIG. 6 is an exploded view of a lamp casing structure in accordance with the third preferred embodiment of the present invention.

With reference to FIGS. 5 and 6 for a lamp casing structure in accordance with the third preferred embodiment of the present invention, the lamp casing structure comprises a predetermined quantity of frame strips 20, a first transparent cover 30, a dust cover 60, and a predetermined quantity of fasteners 40.

The frame strip 20 are coupled with one another and disposed around the periphery of the first transparent cover, and each frame strip 20 includes an insert slot 21 formed on an internal side of the frame strip 20 for embedding the light board 10, and each frame strip 20 includes a latch portion 22 disposed at the middle section of the frame strip 20.

The first transparent cover 30 is the main light emitting surface of the lamp casing structure, and the first transparent cover 30 includes a latch portion 31 disposed at the periphery of the first transparent cover 30 and corresponding to the middle section of the frame strip 20.

The dust cover 60 is a plate installed on another side of the first transparent cover 30, and the dust cover 60 includes an embedding groove 61 formed around the periphery of the dust cover 60 and corresponding to the internal side of the frame strip 20.

Each fastener 40 is installed at the latch portion 22 of each frame strip 20, and each fastener 40 includes a first latch 41 for latching the latch portion 22 of the frame strip 20, and a second latches 42 for latching the latch portion 31 of the first transparent cover 30.

In the lamp casing structure of this preferred embodiment, the dust cover 60 is installed at the light board 10 and opposite to another side with the first transparent cover 30 and provided for a shielding purpose, so that the dust cover 60 can provide a shielding effect and a more aesthetic appearance of the lamp casing structure.

Figure 7:
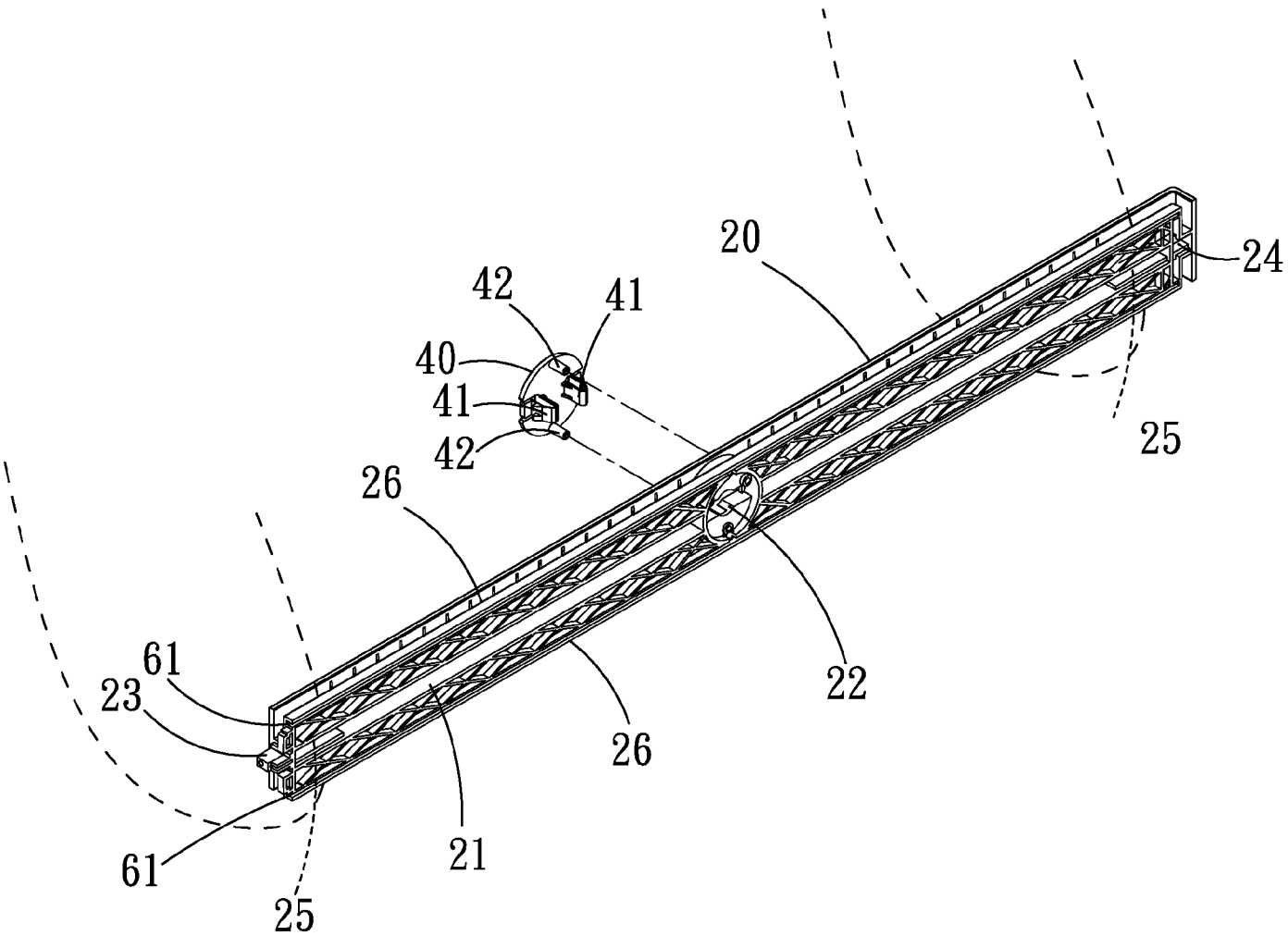
FIG. 7 is a perspective view of a frame strip of a preferred embodiment of the present invention.

With reference to FIG. 7 for a perspective view of a frame strip of a preferred embodiment of the present invention, the lamp casing structure in accordance with each of the foregoing preferred embodiments of present invention comprises at least one bump 23 formed at an end of each frame strip 20, and a recess 24 formed at another end of each frame strip 20 and opposite to the corresponding bump 23, so that the frame strips at edges of the light board can be coupled with one another to enhance the structural strength of the lamp casing structure.

Figure 8:
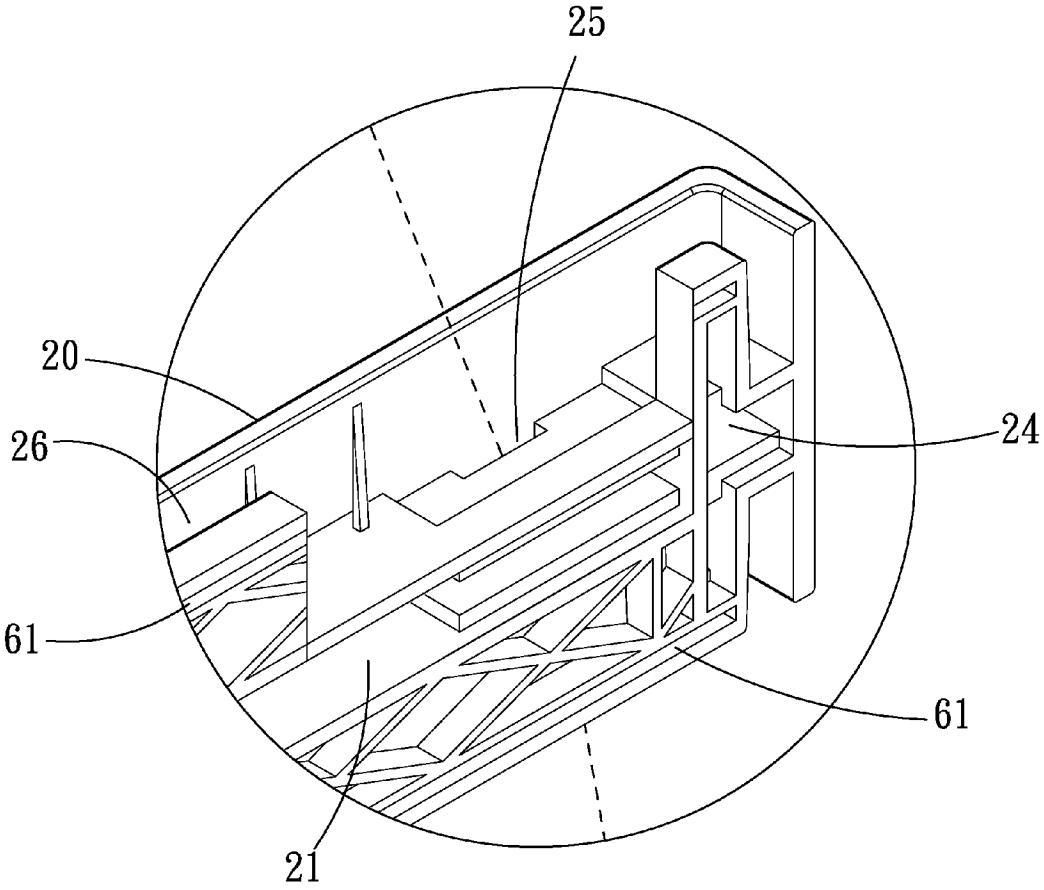
FIG. 8 is a partial close-up view of a frame strip of the present invention.
Figure 12:
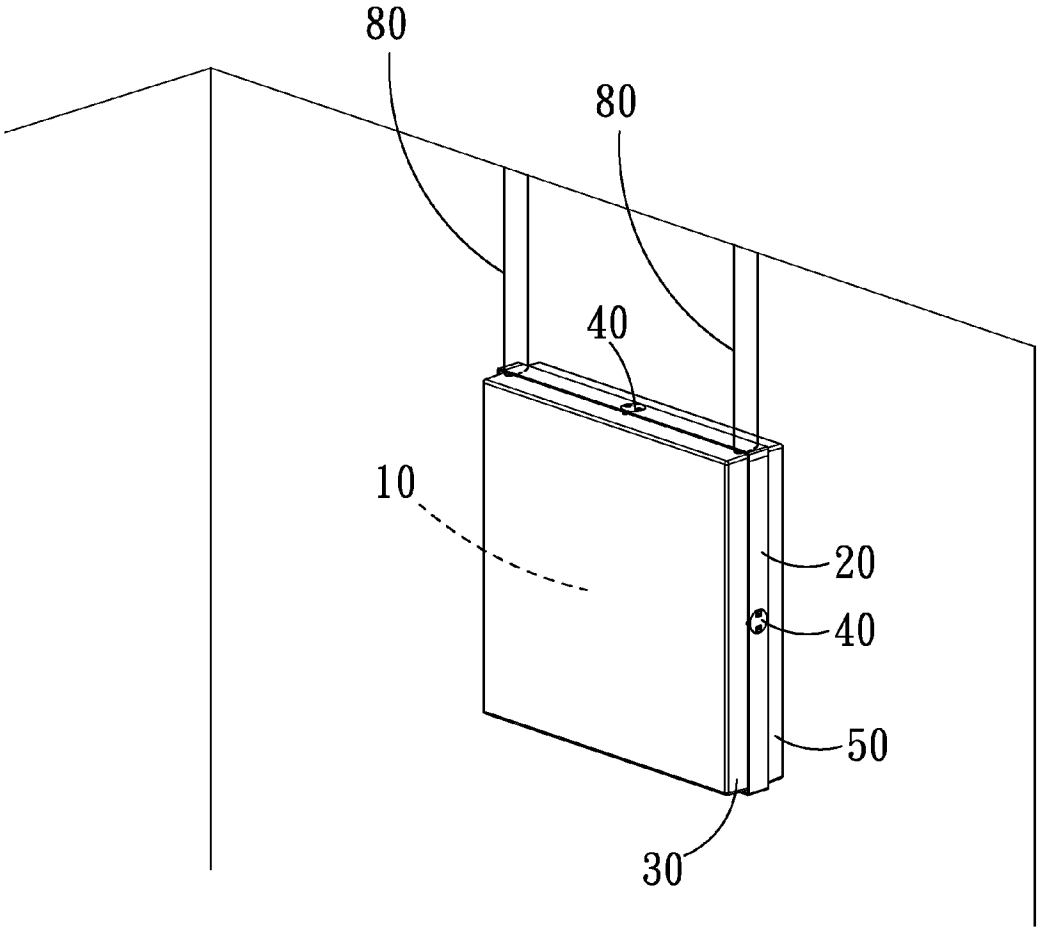
FIG. 12 is a schematic view of an application of a lamp casing structure vertically hanged in accordance with the present invention.
Figure 13:
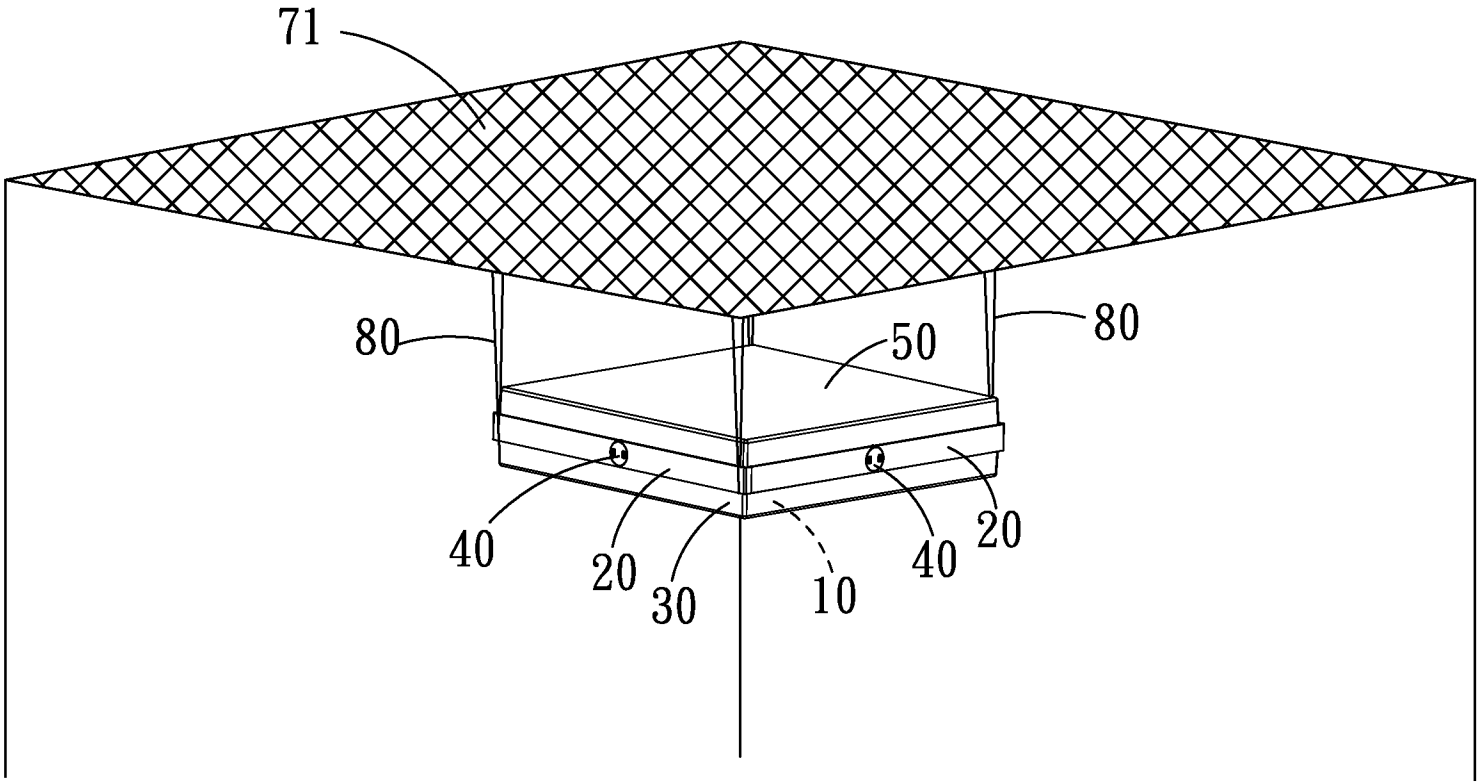
FIG. 13 is a schematic view of an application of a lamp casing structure horizontally hanged in accordance with the present invention.

In FIG. 8, the lamp casing structure in accordance with each of the forgoing preferred embodiments of the present invention, each frame strip 20 includes a through hole 25 penetrated through the top and the bottom and formed on an internal side proximate to both ends of the frame strip, and the through hole 25 is provided for passing a power cable, or the through hole 25 is provided for passing a steel cable 80 as shown in FIGS. 12 and 13, such that the lamp casing structure can be installed by a hanging method. Each frame strip 20 also includes a through hole (not shown in the figure) penetrated through the top and the bottom and disposed opposite to the internal side of the latch portion for passing a power cable or installing a circuit.

In each of the foregoing preferred embodiments of the present invention, each frame strip 20 as shown in FIG. 7 includes a positioning groove 26 formed at the bottom of the frame strip 20 for embedding an edge of the first transparent cover to enhance the effect of positioning the first transparent cover. The lamp casing structure of the second preferred embodiment the present invention comprises a second transparent cover, and each frame strip 20 includes the positioning groove 26 formed at the bottom of the frame strip 20 for embedding the edge of the first transparent cover and each frame strip 20 further includes a positioning groove 26 formed at the top of the frame strip 20 for embedding an edge of the second transparent cover to enhance the effect of positioning the second transparent cover.

Of course, the lamp casing structure in accordance with the third preferred embodiment of the present invention comprises a dust cover, and each frame strip 20 has a positioning groove 26 formed at the top or the bottom of the frame strip 20 for embedding an edge of the first transparent cover, and also has an embedding groove 61 formed on an internal side of the frame strip 20 for embedding the dust cover to enhance the effect of positioning the dust cover.

Figure 9:
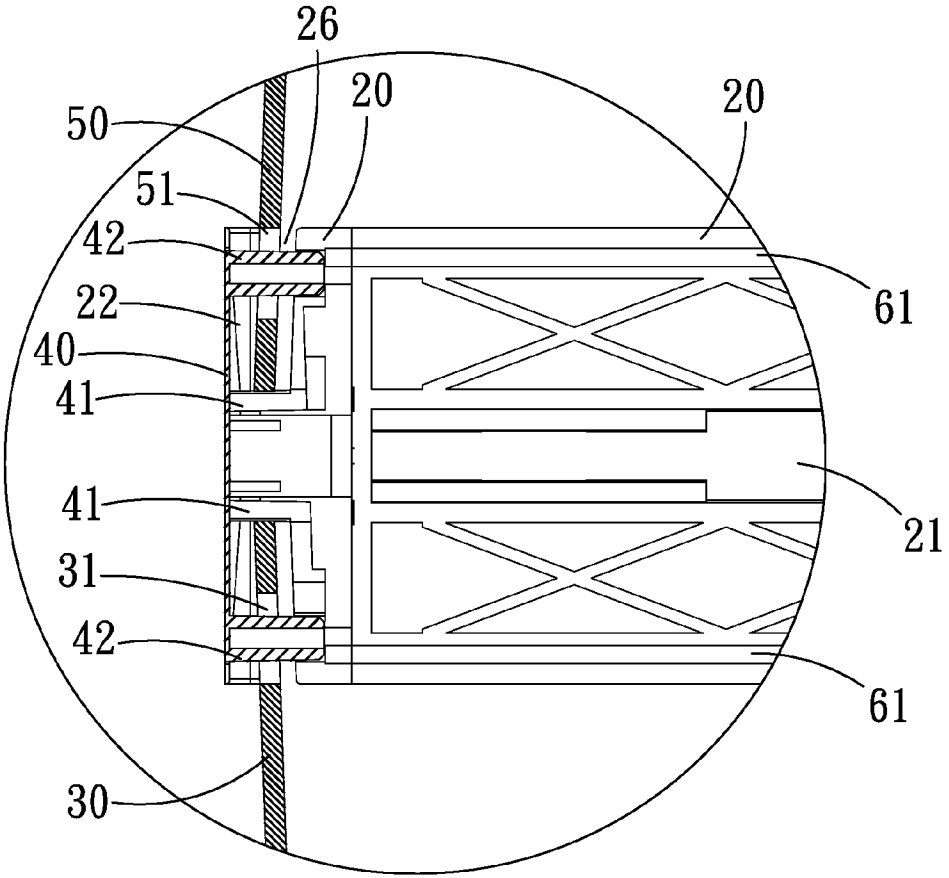
FIG. 9 is a cross-sectional view of a frame strip of a preferred embodiment of the present invention.

In the lamp casing structure of the present invention, the latch portion 22 of each frame strip 20 is a fastening hole, and the first latch 41 of each fastener 40 is comprised of a pair of elastic hook plates. In FIG. 9, the latch portion 31 of the first transparent cover 30 is an insert hole, and the second latch 42 of each fastener 40 is an insert rod.

In FIG. 9, the lamp casing structure of the present invention includes a second transparent cover 50, wherein the latch portion 31 of the first transparent cover 30 and the latch portion 51 of the second transparent cover 50 are insert holes, and the second latch 42 of each fastener 40 is an insert rod.

Figure 14:
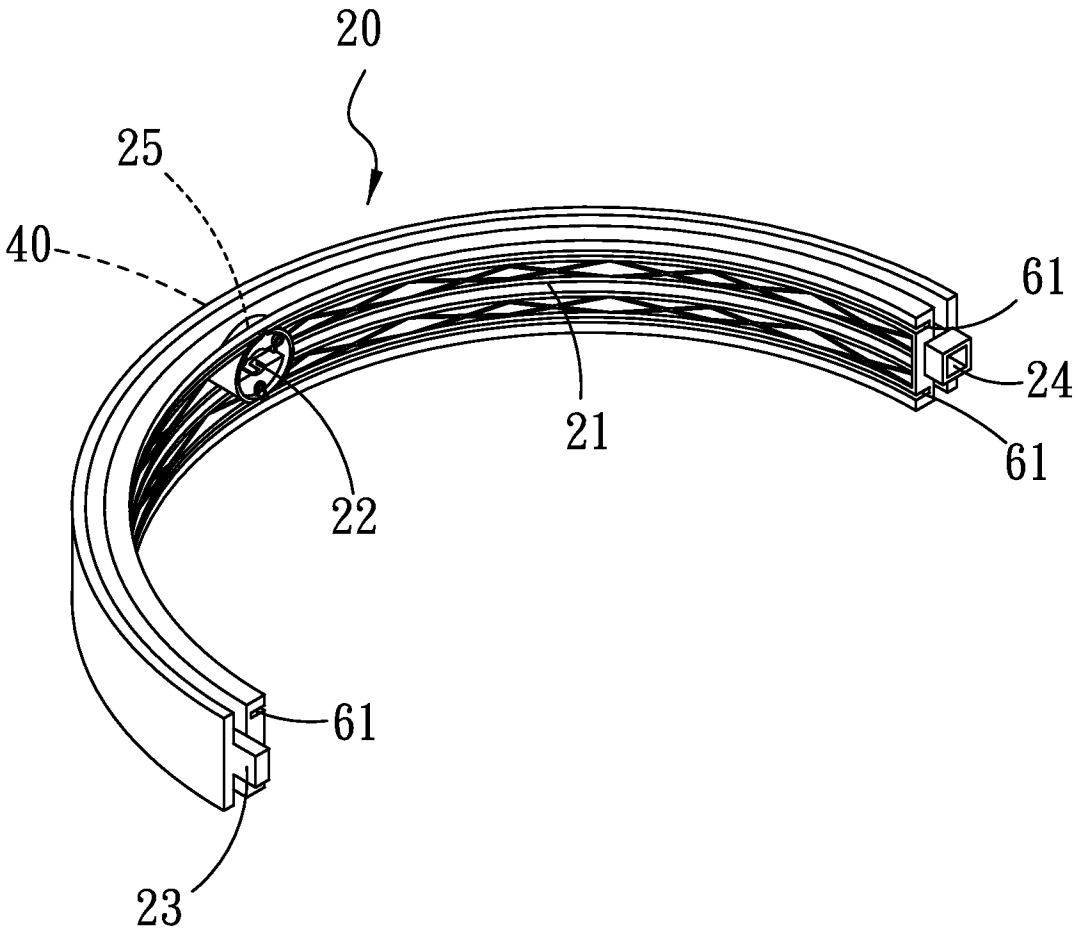
FIG. 14 is a perspective view of a frame strip of another preferred embodiment of the present invention.
Figure 15:
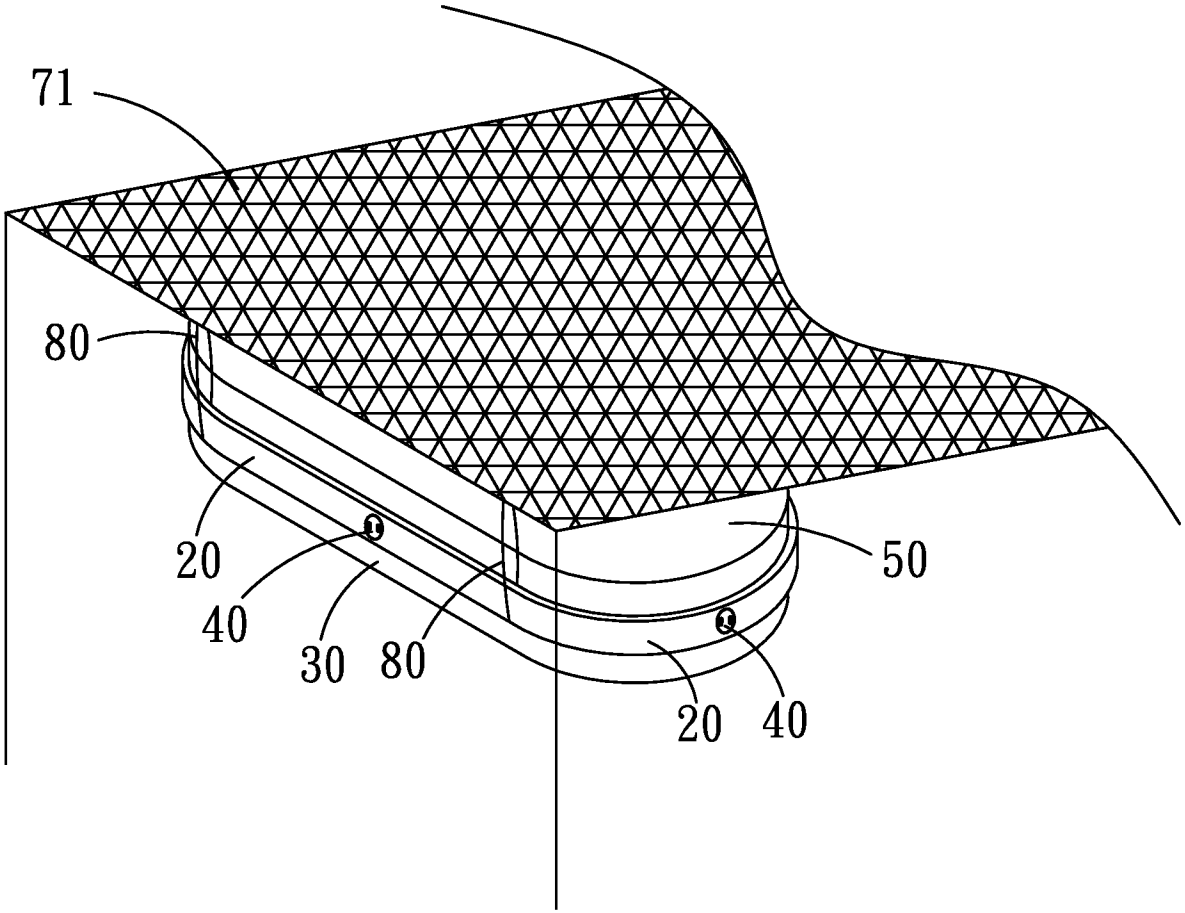
FIG. 15 is a schematic view of an application of a lamp casing structure horizontally hanged in accordance with another preferred embodiment the present invention.
Figure 16:
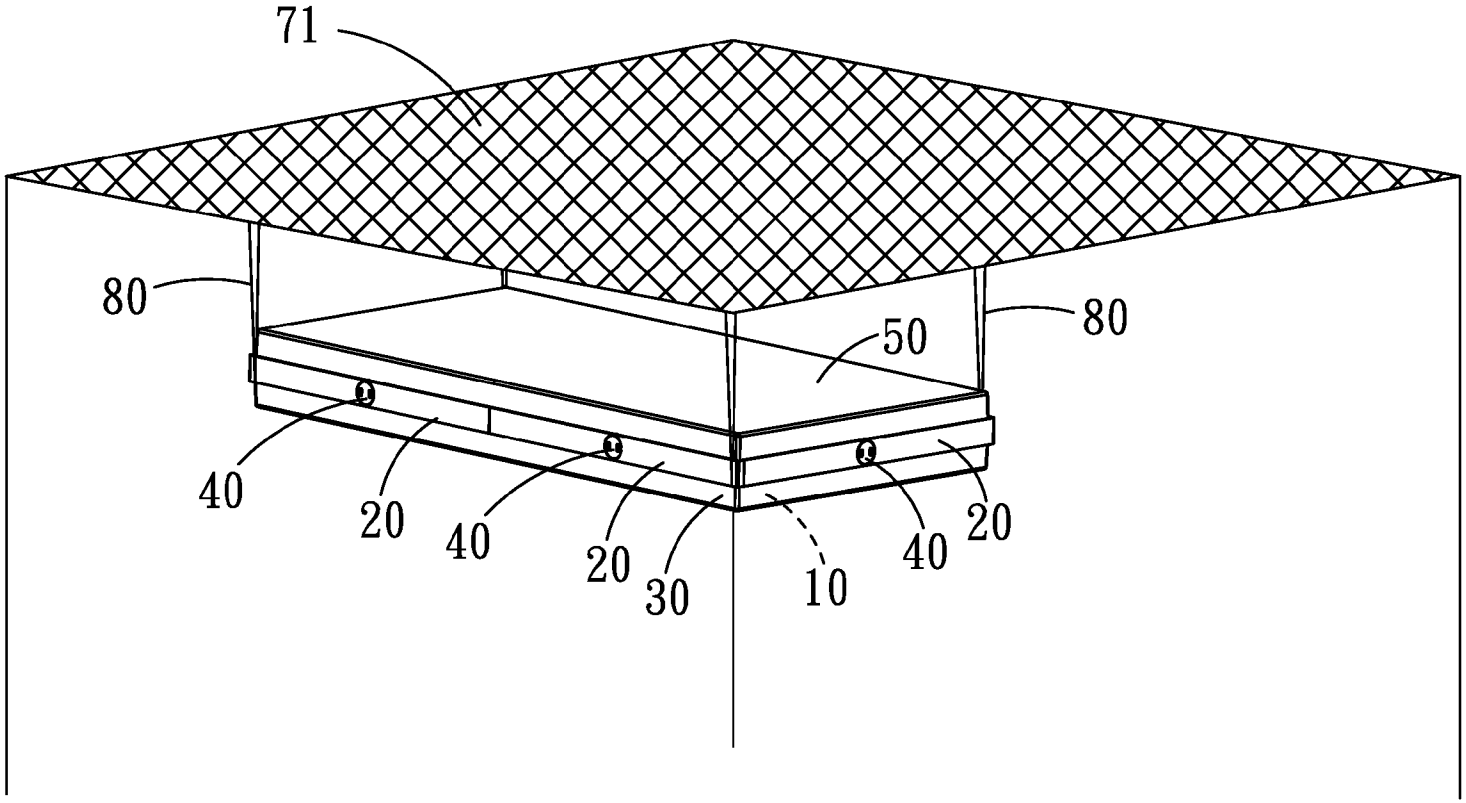
FIG. 16 is a schematic view of an application of a lamp casing structure horizontally hanged in accordance with another preferred embodiment the present invention.

In each preferred embodiment, the first transparent cover 30 has a regular polygonal contour shape, so that the frame strip 20 coupled to the periphery of the first transparent cover 30 is preferably in the shape of a rectangular strip attached to each side of the first transparent cover 30, and a plurality of frame strips 20 can be used (as shown in FIG. 16). Of course, the first transparent cover 30 of the present invention can also have a circular contour shape, so that the frame strips 20 can be coupled with one another and installed around the periphery of the first transparent cover 30 as shown in FIGS. 14 and 15 and preferably has a circular arc shape matched with the first transparent cover 3, so that the lamp casing structure of the present invention can have more stylish changes.

Compared with the conventional structure, the lamp casing structure of the present invention can be installed easily by a simple fastening process, not only providing an easy installation, but also lowering the installation cost. Particularly, the lamp casing structure of the present invention can be installed on a wall or a ceiling, embedded into grids of a light steel frame, or hanged by a steel rope. Obviously, the present invention improves over the prior art and complies with the patent application requirements.

While the invention has been described by means of specific embodiments, numerous modifications and variations could be made thereto by those skilled in the art without departing from the scope and spirit of the invention set forth in the claims.

What is claimed is:

1. A lamp casing structure, comprising: a first transparent cover, a predetermined quantity of frame strips, and a predetermined quantity of fasteners; characterized in that:

the frame strips are coupled with one another and disposed around a periphery of the first transparent cover, and each of the frame strips includes an internal side facing inwardly, a top side, a bottom side and an insert slot formed on the internal side of the frame strip for receiving and holding a light board, and each frame strip includes a latch portion disposed at a middle section of the frame strip;

the first transparent cover includes a latch portion disposed around the first transparent cover and at a position corresponding to the middle section of each of the frame strips; and each of the fasteners includes a first latch configured to connect to the latch portion of the frame strip and a second latch configured to connect to the latch portion of the first transparent cover.

2. The lamp casing structure of claim 1, wherein each frame strip includes at least one bump formed at an end of the frame strip, and a recess formed at another end of each frame strip opposite to the bump and corresponding to the bump.

3. The lamp casing structure of claim 1, wherein each frame strip includes a through hole penetrated through the top side and the bottom side of the frame strip and formed on the internal side of the frame strip and proximate to both ends of the frame strip.

4. The lamp casing structure of claim 1, wherein each frame strip includes a positioning groove formed at the bottom side of the frame strip for receiving and holding an edge of the first transparent cover.

5. The lamp casing structure of claim 1, wherein the latch portion of each frame strip is a fastening hole, and the first latch of each fastener is comprised of a pair of elastic hook plates.

6. The lamp casing structure of claim 1, wherein the latch portion of the first transparent cover is an insert hole, and the second latch of each fastener is an insert rod.

7. The lamp casing structure of claim 1, wherein each frame strip includes a through hole penetrated through the top side and the bottom side of the frame strip and formed on the internal side of the frame strip and opposite to the latch portion.

8. The lamp casing structure of claim 1, wherein each frame strip includes a through hole penetrated through the top side and the bottom side of the frame strip and formed on the internal side of the frame strip and proximate to both ends of the frame strip.

9. A lamp casing structure, comprising:

a first transparent cover, predetermined quantity of frame strips, a second transparent cover, and predetermined quantity of fasteners; characterized in that:

the frame strips are coupled with one another and disposed around a periphery of the first transparent cover, and each of the frame strips includes an internal side facing inwardly, a top side, a bottom side and an insert slot formed on the internal side of the frame strip for receiving and holding a light board, and each frame strip includes a latch portion disposed at a middle section of the frame strip;

the first transparent cover includes a latch portion disposed around the first transparent cover and at a position corresponding to the middle section of each of the frame strips;

the second transparent cover has a contour shape matched with the first transparent cover for sheathing the second transparent cover on the other side of the first transparent cover, and further includes a latch portion disposed around the second transparent cover and at a position corresponding to the middle section of each of the frame strips; and each of the fasteners includes a first latch configured to connect to the latch portion of the frame strip and two second latches each configured to connect to the latch portion of the first transparent cover and the latch portion of the second transparent cover respectively.

10. The lamp casing structure of claim 9, wherein each frame strip includes at least one bump formed at an end of the frame strip, and a recess formed at another end of each frame strip opposite to the bump and corresponding to the bump.

11. The lamp casing structure of claim 9, wherein each frame strip includes a positioning groove for receiving and holding an edge of the first transparent cover and another positioning groove formed at the top side of the frame strip for receiving and holding an edge of the second transparent cover.

12. The lamp casing structure of claim 9, wherein the latch portion of each frame strip is a fastening hole, and the first latch of each fastener is comprised of a pair of elastic hook plates.

13. The lamp casing structure of claim 9, wherein the latch portion of the first transparent cover is an insert hole, and the second latch of each fastener is an insert rod.

14. The lamp casing structure of claim 9, wherein the latch portion of the first transparent cover and the latch portion of the second transparent cover are insert holes, and the second latch of each fastener is an insert rod.

15. The lamp casing structure of claim 9, wherein each frame strip includes a through hole penetrated through the top side and the bottom side of the frame strip and formed on the internal side of the frame strip and opposite to the latch portion.

16. A lamp casing structure, comprising:

a first transparent cover, a predetermined quantity of frame strips, a dust cover, and a predetermined quantity of fasteners, characterized in that:

the frame strips are coupled with one another and disposed around a periphery of the first transparent cover, and each of the frame strips includes an internal side facing inwardly, a to side, a bottom side and an insert slot formed on the internal side of each frame strip for receiving and holding a light board, an embedding groove for receiving and holding the dust cover, and a latch portion disposed at a middle section of each frame strip;

the first transparent cover includes a latch portion disposed around the first transparent cover and at a position corresponding to the middle section of each of the frame strips; and the dust cover is a plate sheathed on another side of the first transparent cover; and each of the fasteners includes a first latch for connection to the latch portion, and a second latch for latching the latch portion of the first transparent cover.

17. The lamp casing structure of claim 16, wherein each frame strip includes at least one bump formed at an end of the frame strip and a recess formed at another end of the frame strip and opposite to the corresponding bump.

18. The lamp casing structure of claim 16, wherein each frame strip includes a positioning groove for receiving and holding an edge of the first transparent cover and an embedding groove formed on the internal side of the frame strip for receiving and holding the dust cover.

19. The lamp casing structure of claim 16, wherein the latch portion of each frame strips is a fastening hole, and the first latch of each fastener is comprised of a pair of elastic hook plates.

20. The lamp casing structure of claim 16, wherein the latch portion of the first transparent cover is an insert hole, and the second latch of the fastener is an insert rod.

* * * * *